US006539558B2

(12) United States Patent
Shero

(10) Patent No.: US 6,539,558 B2
(45) Date of Patent: Apr. 1, 2003

(54) MULTI-FUNCTION, COMFORT WHEEL CHAIR

(76) Inventor: Kathryn Shero, 155 Mapleview Dr., Eggertsville, NY (US) 14226

( * ) Notice: Subject to any disclaimer, the term of this patent is extended or adjusted under 35 U.S.C. 154(b) by 0 days.

(21) Appl. No.: 09/803,755

(22) Filed: Mar. 12, 2001

(65) Prior Publication Data

US 2001/0010099 A1 Aug. 2, 2001

Related U.S. Application Data

(63) Continuation-in-part of application No. 09/387,121, filed on Aug. 31, 1999, now abandoned.

(51) Int. Cl.[7] ..... A61G 7/02
(52) U.S. Cl. ..... 4/480; 297/DIG. 4
(58) Field of Search ..... 4/480; 297/DIG. 4

(56) References Cited

U.S. PATENT DOCUMENTS 557,614 A * 4/1896 Schmitt
1,691,620 A * 11/1928 Wilson
3,381,973 A * 5/1968 Carr ..... 4/480 X
4,296,506 A * 10/1981 Stoute, Sr. et al.
4,632,450 A * 12/1986 Holdt
4,713,848 A * 12/1987 Domovs et al. ..... 4/480
4,795,214 A * 1/1989 Holdt
4,928,328 A * 5/1990 Davis
4,949,408 A * 8/1990 Trkla ..... 297/DIG. 4
5,255,934 A * 10/1993 Wilson
5,285,535 A * 2/1994 Stewart et al.
5,438,721 A * 8/1995 Pahno et al. ..... 4/480 X
5,577,753 A * 11/1996 Pociask
5,608,925 A * 3/1997 Porter

FOREIGN PATENT DOCUMENTS

GB 0880385 * 8/1949 ..... 4/480

* cited by examiner

*Primary Examiner*—Charles E. Phillips
(74) *Attorney, Agent, or Firm*—John D. Gugliotta

(57) ABSTRACT

An improved, multi-function, comfort wheelchair is provided with interchangeable padded seats. A bedpan is positioned on a rail underneath a hole in the seat and accesses a waste storage chamber. The bedpan can be emptied through a door in the front of the containment.

8 Claims, 7 Drawing Sheets

MULTI-FUNCTION, COMFORT WHEEL CHAIR

RELATED APPLICATIONS AND DISCLOSURES

The present invention is a Continuation in Part of U.S. Utility Patent, Ser. No. 09/387,121, filed on Aug. 31, 1999, and herein abandoned.

BACKGROUND OF THE INVENTION

1. Field of the Invention

The present invention relates generally to wheelchairs, and, more particularly, to an improved, multi-function, comfort wheel chair.

2. Description of the Related Art

Physically challenged, or handicapped, people confined to wheelchairs are faced with obstacles on a daily basis that most of us take for granted. Simple travel from place to place becomes a major undertaking that requires considerable effort. While wheelchairs permit greater mobility and ease of movement, they are not the most comfortable chairs to sit in for hours on end.

The devices are not adjustable with respect to leg and back angles as is prevalent with a typical furniture recliner. Such discomfort is the major reason many people transfer to and from the wheelchair throughout the day.

However, this act of transferring from a wheelchair to another chair requires a great deal of effort, and depending on the level of disability, it may require the assistance of other people.

Another instance in which an individual must leave the wheelchair is when it is necessary to use the toilet. This act, especially when performed in a home care situation that may not be the most suitable for handicap access, is extremely stressful, not only for the physically disabled, but for the care giver as well.

An alternative to this situation is the use of a bedpan, which is not very comfortable and often messy. Accordingly, there is a need for a means by which an invalid or a physically disabled individual confined to a wheelchair, can be comfortable while seated in the wheelchair and be able to avoid transfer to toilet facilities every time bathroom activities are required.

In the related art, several devices are disclosed that describe a wheelchair with a bedpan. These include U.S. Pat. No. 5,608,925, issued in the name of Porter, and U.S. Pat. No. 4,296,506, issued in the name of Stoute, Sr. et al.

Several patents describe a wheelchair with a commode seat. These include U.S. Pat. No. 5,577,753, issued in the name of Pociask, U.S. Pat. No. 5,255,934, issued in the name of Wilson, U.S. Pat. No. 4,795,214, issued in the name of Holdt, U.S. Pat. No. 4,632,450, issued in the name of Holdt, U.S. Pat. No. 1,691,620, issued in the name of Wilson, and U.S. Pat. No. 557,614, issued in the name of Schmitt.

U.S. Pat. No. 5,285,535, issued in the name of Stewart et al., discloses a portable toilet for a collapsible incontinent wheelchair.

U.S. Pat. No. 4,928,328, issued in the name of Davis, describes a commode for securing to a wheelchair.

One common problem associated with toilet and wheelchair combinations is the storage and disposal means employed. All too often, the device permits foul odors to be emitted from the apparatus, thereby decreasing the desirability of using the device. Another problem associated with such devices is that the device may not facilitate sanitary containment and disposal of the feces and urine.

A search of the prior art did not disclose any patents that anticipate directly many features of the instant invention. Consequently, a need has been felt for providing an apparatus and method which overcomes the problems cited above.

SUMMARY OF THE INVENTION

It is therefore an object of the present invention to provide an improved, multi-function, comfort wheel chair which allows an invalid or a physically disabled individual confined to a wheelchair to be comfortably seated in the wheelchair and also avoid transfer to toilet facilities every time bathroom activities are required.

Briefly described according to one embodiment of the present invention, an otherwise conventional wheelchair is disclosed. The wheelchair may be motorized or of a conventional, nonmotorized design. The leg members and associated braces are adjustable in conjunction with the back member to allow the user to position himself or herself in the reclined position. Reclining of the leg member and back member is achieved via an electric motor. A control means facilitates control of the electric motor, and is located on one of the armrests. A bedpan is positioned underneath the hole in the padded seat, in a waste storage chamber. A filtration means is used to control odor from the use of the bedpan.

It is another object of the present invention to provide a device that permits the user to rest in the reclined position.

It is another object of the present invention to provide a device that provides greater leg and back support than a traditional wheelchair.

It is another object of the present invention to provide a device that has a built in bed pan that is easy to use and easy and sanitary to clean.

It is another object of the present invention to provide a device that permits use of the wheelchair as a commode, with no foul odors emitted from the device after use.

It is another object of the present invention to provide a device that facilitates the sanitary storage and disposal of the feces and urine after use.

It is another object of the present invention to provide a device that allows movement of the wheelchair with minimal strength of the user.

Other objects of the present invention include providing a device that portable and lightweight.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENTS

The best mode for carrying out the invention is presented in terms of its preferred embodiment, herein depicted within the FIGS. 1 through 8.

1. Detailed Description of the Figures

Figure 1:
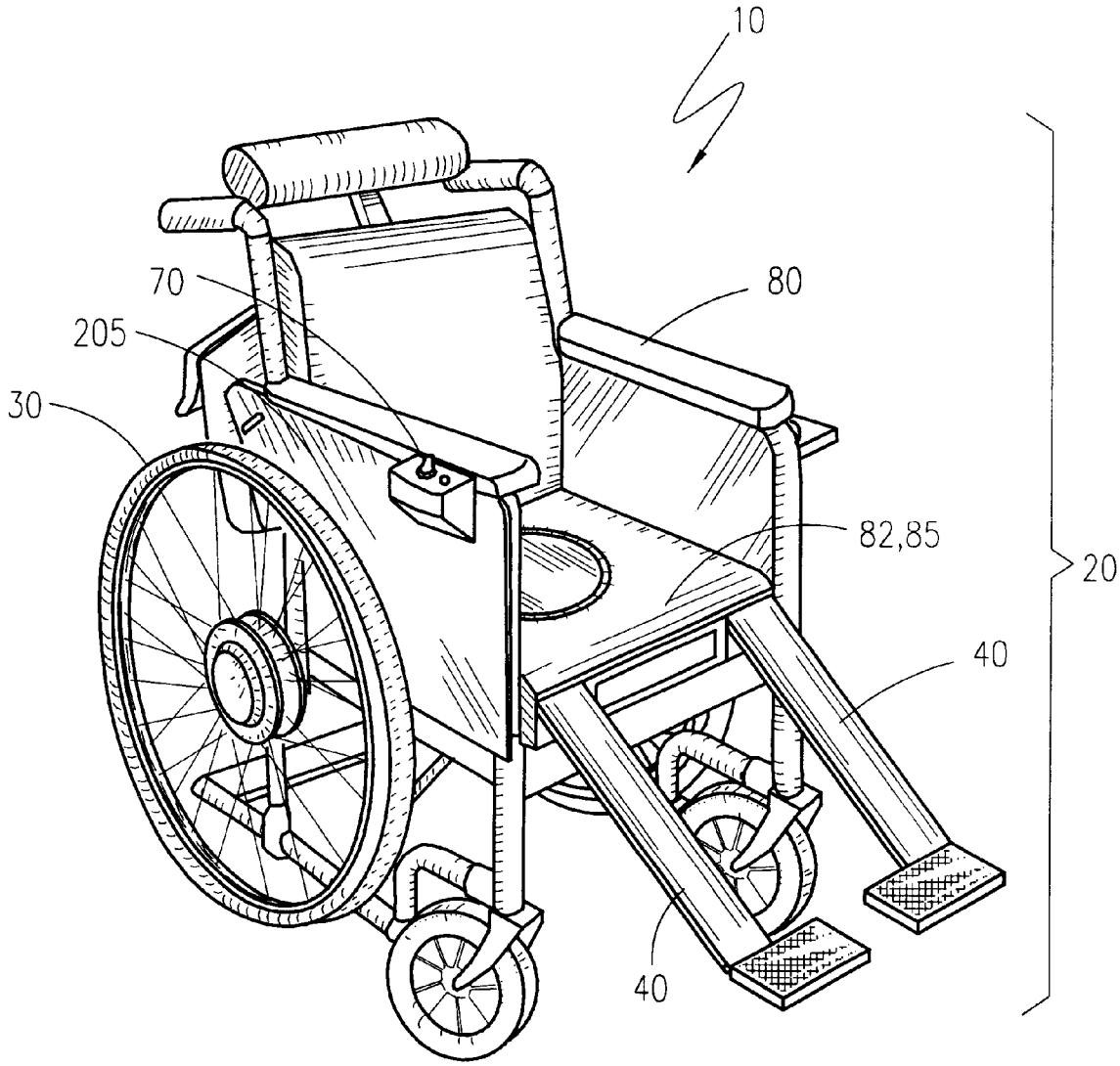
FIG. 1 is a perspective view of the preferred embodiment of improved, multi-function, comfort wheel chair 10.

Referring now to FIG. 1, and improved, multifunction, comfort wheelchair 10 is shown. In general the overall appearance and configuration of the present invention resembles an otherwise conventional wheelchair 20, herein shown as a motorized type but capable of being adapted to a non-motorized manual type. The wheelchair 20 is equipped with wheels 30 similar in appearance and function to those on a conventional wheelchair 20.

Figure 2:
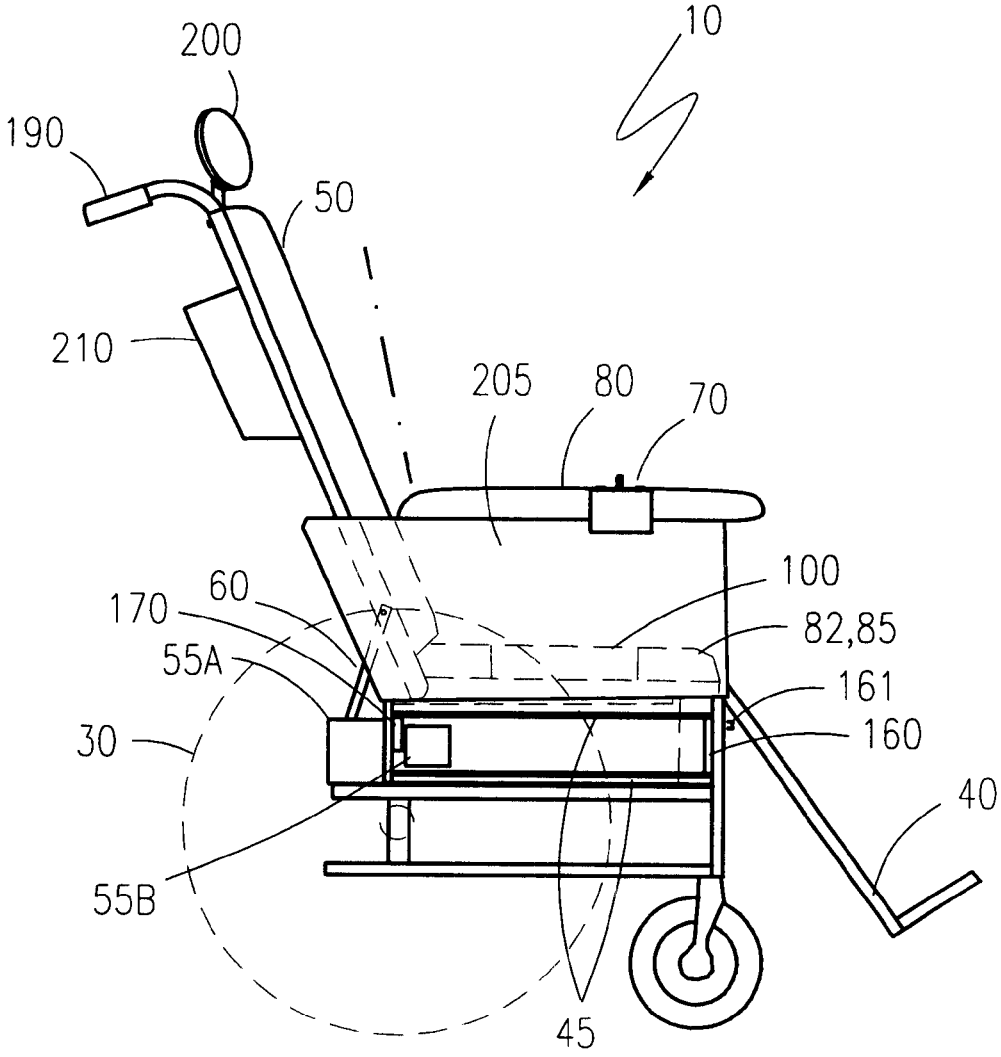
FIG. 2 is a left side view of preferred embodiment in the reclined position.

Referring now to FIGS. 1 and 2, a pair of pivotally affixed leg supports 40 are provided, each pivotally affixed to the wheelchair 20 at an upper hinge. Similarly, a back support member 50 and associated braces are provided and are adjustable in conjunction with the back support member 50 to allow the user to position himself or herself between an upright and a reclined position. Reclining of the back support member 50 is achieved via an electric motor 55*a*. The electric motor 55*a* is located in the center of the lower portion of the wheelchair 20 in order to provide sufficient leverage to recline the back support member 50 to a variety of angles, for the comfort of the user.

Figure 3:
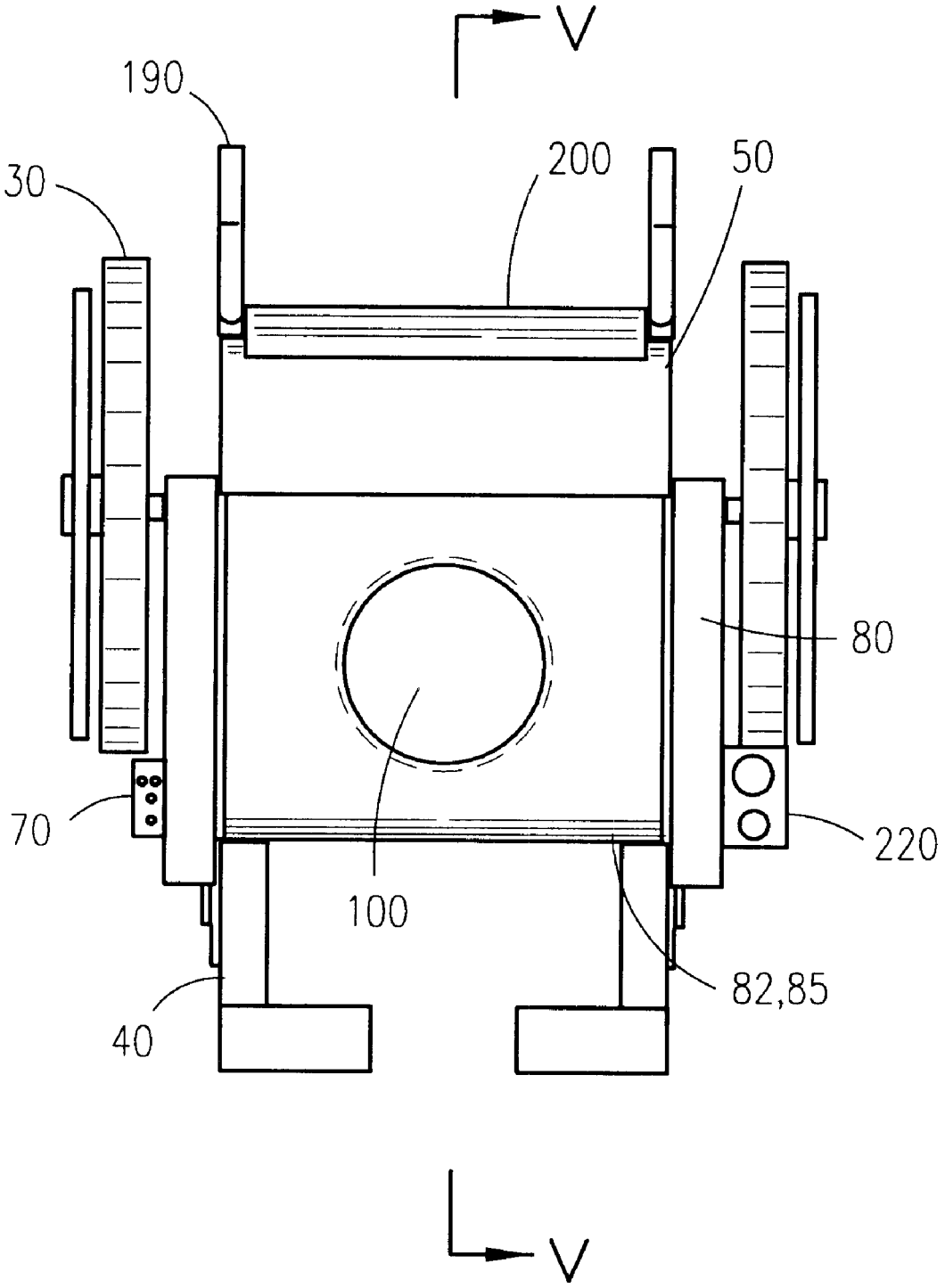
FIG. 3 is a top view of the preferred embodiment.

In conjunction with FIG. 3, a control means 70 facilitates control of the electric motors 55*a* and 55*b* and is located on an armrest 80. The control means 70 is depicted as a control pad, with buttons to control the movement of the back, as well as to control the movement of the legs as will be described in greater detail below. The control means 70 may also incorporate traditional motorized wheelchair 20 control buttons.

Figure 4:
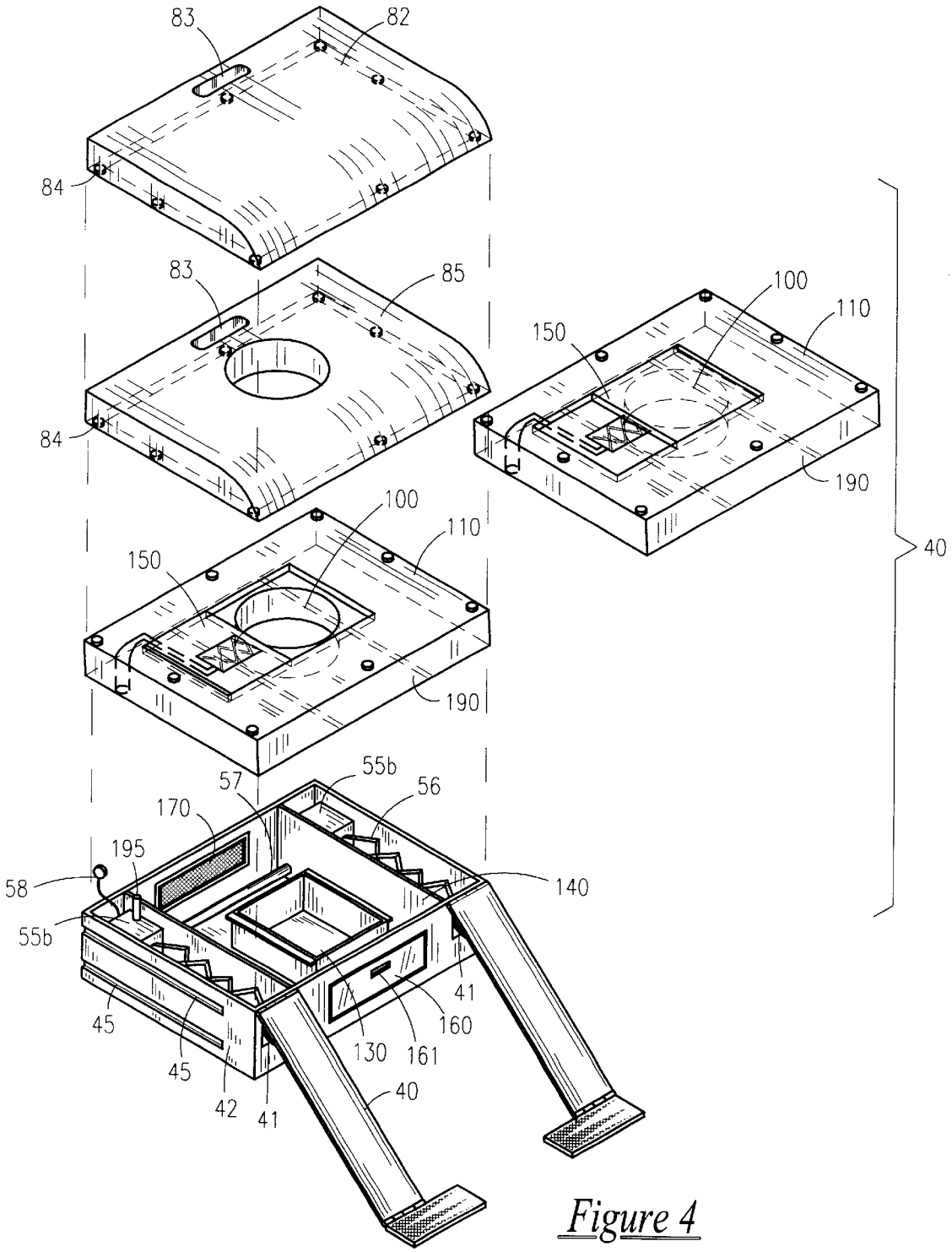
FIG. 4 is a partial front, exploded view of first alternate embodiment for removable seats 82, 85 for use therewith.

In conjunction with FIG. 4, a center assembly including the commode assembly as well as the legs 40 and leg actuation motors 55*b* is shown. The legs 40, being pivotally affixed to the housing, can be urged forward by the motors 55*b* by a drive shaft 56 and a curved metal extension 41 that can extend and contract when driven by the motors 55*b*. A motor linkage 57 coordinates the motions of the separate leg drive motors 55*b*. A padded first seat 82 removably attaches to a 110 metal unit, and interchanges with a padded second seat 85 that has an access orifice 100 penetrating there through. The padded seats 82, 85 are sufficiently wide to accommodate larger sized individuals. The orifice 100 is formed from the padded seat 85 and is of sufficient cross sectional diameter so as to facilitate sanitary urination and excretion of bodily fluids though the hole 100 in the seat. The commode pan 130 has a top edge to slide unto 190 rail at the bottom of 110 metal unit. The 195 connector goes from 55*b* leg motor to 150 chamber sealing means with a middle drive shaft that extends over 100 hole. The 150 chamber sealing means is located in the middle of 110. Seats 82,85 have snaps 84 on the bottom of the seats that attach onto the metal holders on the top of the 110 metal unit. Hand openings 83 are on the back of 82, 85 padded seats to pull off seats from 110 metal unit. A pair of slide rails 45 formed at either side of the assembly housing 42, allow for slidable engagement of the assembly into and out from the wheelchair 20. The electric attachment 58 to the arm rest from 55*b* motor is detachable so that the whole commode and leg housing 49 can pull out and you can fold the wheelchair 20 together.

Figure 5:
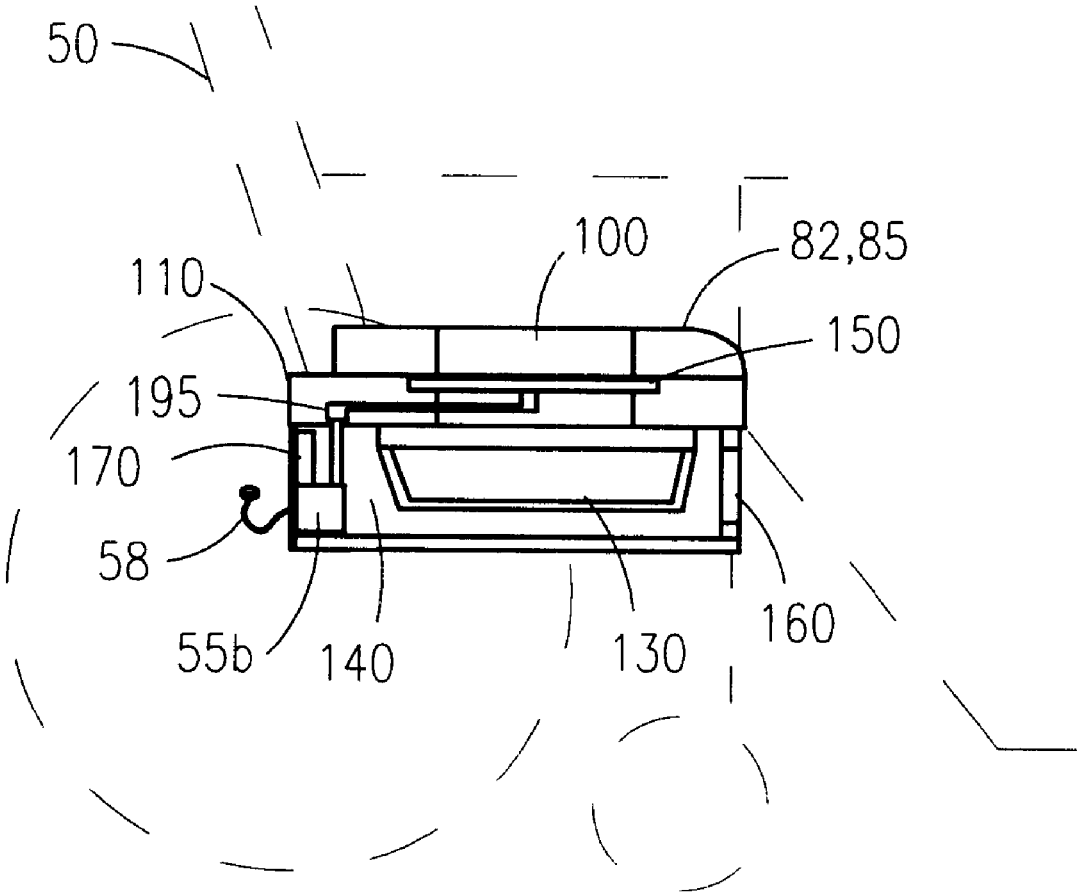
FIG. 5 is a cross sectional view cut along line V—V of FIG. 3.
Figure 6:
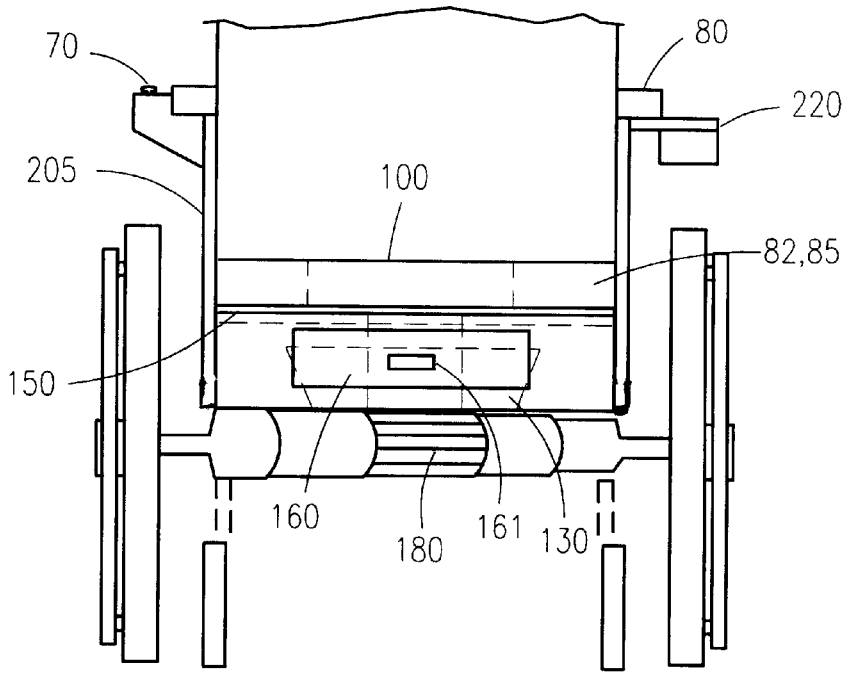
FIG. 6 is a rear, exploded view of the preferred embodiment.

In conjunction with FIGS. 5 and 6, a bedpan 130 is positioned underneath the orifice 100 in a waste storage chamber 140. The waste storage chamber 140 is located underneath the seat and metal unit 110 and is accessible via the hole 100 in the seat. The waste storage chamber 140 is designed so as to hold the commode pan 130 securely with a rail 190, directly under the hole 100 in the metal unit 110. A chamber hatch 160 permits access to the bedpan 130 in the storage chamber. With an inverted handle 161 on 160 chamber door.

Figure 7:
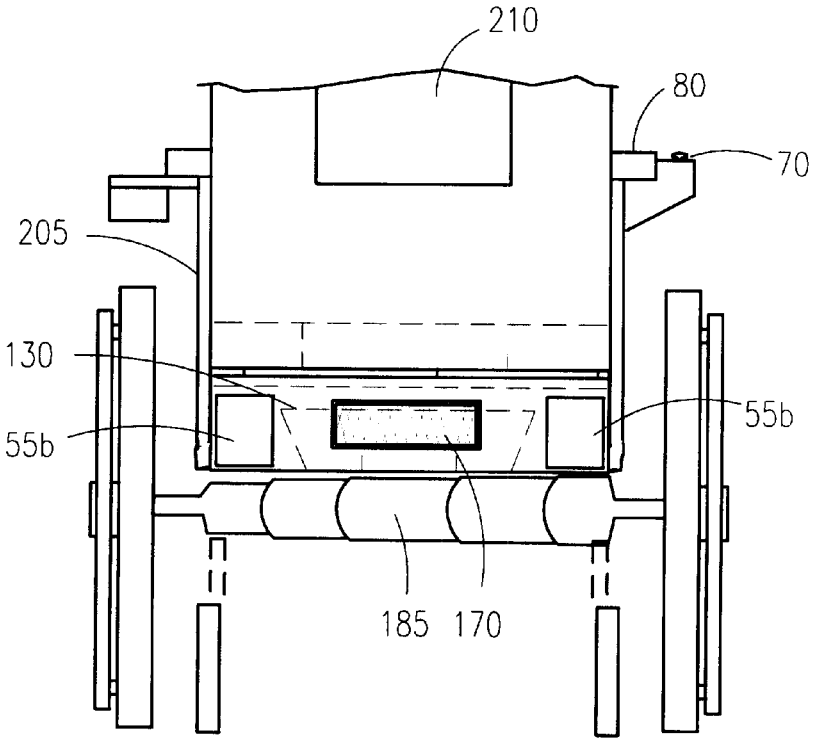
FIG. 7 is a rear view thereof.

Referring now to FIGS. 5, 6 and 7, the waste storage chamber 140 may be sealed after use via a chamber sealing means 150. For purposes of disclosure, the chamber sealing means 150 is depicted as a slidable metal sheet with a drive shaft that covers the hole 100 when activated.

It is envisioned that when the chamber door 160 is in the closed position and when the chamber hatch 150 is closed, the waste storage chamber 140 is generally air tight.

Referring now to FIGS. 6 and 7, a filtration means 170 is used to control odor from the use of the bedpan 130. For purposes of disclosure, the filtration means 170 is depicted as a carbon filter. The filtration means 170 is located inside of the waste storage chamber 140 and may be replaceable in design, and is activated via a filtration means control switch 175, located on the arm rest 80 of the wheelchair 20.

Referring now to FIGS. 1 through 7, the anterior, lower portion of the wheel chair is weighted 180 so as to counterbalance the backward weight shift that occurs when the wheel chair is in the reclining position and keep the wheelchair 20 from tilting backwards. The main axle 185 is anticipated as being collapsible and telescoping in design, thereby allowing for the entire chair to be folded together for transport and storage.

A pair of handles 190 are located at the posterior of the back member 50, and are designed to be vertically adjustable, so as to accommodate people of varying heights.

Referring now to FIGS. 1 through 5, a headrest 200 is located at the top portion of the back member 50 of the wheel chair. The headrest 200 spans the entire lateral width of the wheel chair. For purposes of disclosure, the headrest 200 is depicted as being a pillow headrest 200 of a generally rectangular configuration.

The headrest 200 is attached to the back member 50 along the upper edge of the headrest 200, so as to facilitate upward rotation of the headrest 200 above and behind the back member 50. The configuration allows the headrest 200 to be moved out of the way when desired by the occupant of the wheelchair 20, as well as to allow the chair to fold together for storage or transport, or it can stay secure.

A privacy shield 205 is positioned along the exterior lateral, and posterior perimeter of the wheel chair 20. The privacy shield 205 is designed to provide a visual barrier to provide privacy to the individual while using the present invention. The privacy shield 205 extends from the top of the arm rest 80 to below the lateral sides of the wheel chair. For purposes of disclosure, the privacy shield 205 is depicted as a curtain. Other configurations, such as a leather privacy shield 205, are envisioned.

Referring now to FIGS. 6 and 7, it is envisioned that a detatchable or secure backpack or similar article carrying means 210 is located along the posterior surface of the back member 50. For purposes of disclosure, a backpack is disclosed. A detachable, or secure multi-sized cup holder 220 is also located on the wheelchair 20.

It is envisioned that other styles and configurations of the present invention can be easily incorporated into the teachings of the present invention, and only one particular configuration shall be shown and described for purposes of clarity and disclosure and not by way of limitation of scope.

Figure 8:
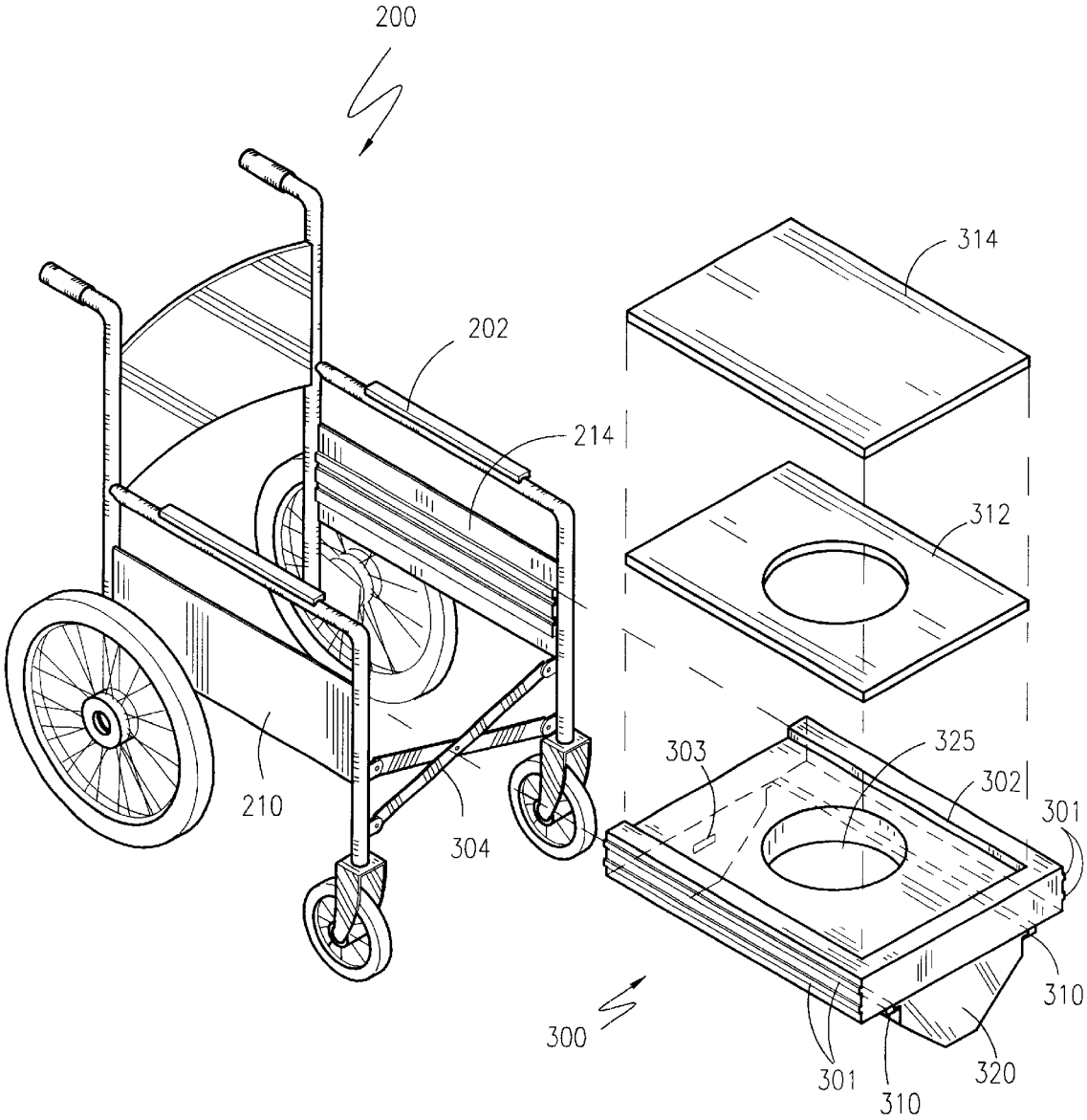
FIG. 8 is a perspective view of a commode attachment apparatus for use with a cross-type wheelchair frame.

In FIG. 8, a padded commode seat 312 that is interchangeable with a regular padded seat 314. The trapezoidal commode pan 320 fits under the unit 300 on a rail 310 to slide in and out of the commode unit. Side rails 301 on commode unit 300 go on both sides to slide unit in place and secure the criss-cross type wheelchair. Top ridge on the commode unit 302 lets you slide the seats 312 commode and 314 regular padded seats in place. In the back of the chair is an inverted handle 303 on the commode pan 320, press down handle and it releases latch to pull out pan and empty, also slides back in place and handle snaps up to secure pan in place. The whole unit 300, 320 attached pulls out so you can fold the criss-cross type wheelchair together. This provides comfortable padded seats, access to bathroom needs without unnecessary transport from the wheelchair, and unit is removable to fold criss-cross wheelchair together.

2. Operation of the Preferred Embodiment

To use the present invention, the operator uses the control means 70 to adjust the angle of the leg member and back member. When the operator needs to use the bathroom, he or she simply adjusts their garments accordingly relieves themselves, seals the waste chamber, and activates the filtration means 170. The bedpan 130 inside of the waste chamber can be removed when convenient by opening the chamber hatch 160.

In the criss-cross wheelchair shown in FIG. 8, when the operator needs to use the bathroom, he or she simply adjusts their garments, relieves themselves and adjusts their clothing. The padded seats, 312-commode and 314-regular seat are interchangeable. The trapezoidal commode pan 320 empties by pulling it out the back of the said wheelchair. Rails 301 are on both sides of the commode unit 300 so it can be pulled out from the wheelchair sides to be folded up.

The foregoing description is included to illustrate the operation of the preferred embodiment and is not meant to limit the scope of the invention. The scope of the invention is to be limited only by the following claims.

What is claimed is:

1. An improved, multi-function, comfort wheel chair, comprising: conventional wheel chair structure including arm rests, a back support member, a seat, and a pair of adjustable leg members;

an electric motor, said electric motor used to move said leg members;

a control means, said control means designed to facilitate control of said electric motor, with said control means located on one of said armrests of said wheelchair;

an assembly housing, said assembly housing containing a bedpan, said electric motor, filtration means, and a sealing system to make said commode generally airtight, and having a unit covering said assembly housing and its contents;

said seat and unit each having an opening therethrough aligned with said bedpan to facilitate sanitary urination and excretion of bodily fluids through said holes into said bedpan;

a waste storage chamber, said waste storage located underneath said seat and unit, and being designed to hold said bedpan on rails securely, directly under said unit hole;

a chamber sealing means, said chamber sealing means used to seal said chamber after use, wherein said chamber sealing means is a slidable sheet that covers said unit hole;

a connector extending from said electric motor to said slidable sheet so as to, upon activation thereof, move said sheet from a position over said unit hole in a sealing mode of said chamber, to a position beside said unit hole.

2. The wheelchair of claim 1 wherein said detachable seat comprises:

a seat insert element having a first lateral side opposite a second lateral side;

a first attachment flap, said attachment flap being affixed at one end to said wheelchair and having a first attachment end opposite thereto supporting a plurality of linearly aligned retaining clasps;

a second attachment flap, said second attachment flap being affixed to one end of said wheelchair opposite said first attachment flap and having a second attachment end supporting a plurality of linearly aligned retaining clasps;

a plurality of linearly aligned protrusion clips extend outward from said first lateral side and said second lateral side;

and wherein said seat can be fastened or removed from said chair by connecting or releasing said protrusion clips with said retaining clasps.

3. The wheelchair of claim 1, wherein the improvement further comprises:

said back support member being adjustable to allow the user to position himself or herself between an upright and a reclined position.

4. The wheelchair of claim 1, wherein the reclining of said back support member is achieved via an electric motor in order to recline the back support member to a variety of angles, for the comfort of the user.

5. The wheelchair of claim 1, wherein the improvement further comprises said seat being detachable.

6. The improved, multi-function, comfort wheelchair describer in claim 1, wherein said multi-function, comfort wheelchair further comprises a pair of handles, said handles located at the posterior of said back, and are designed to be vertically adjustable, so as to accommodate people of varying heights.

7. The improved, multi-function comfort wheelchair described in claim 1, wherein said multi-function, comfort wheelchair further comprises a headrest, said headrest located at the top portion of said back member of said wheelchair, said headrest spanning the entire lateral width of said wheelchair that can be detachable or secure.

8. The improved, multi-function comfort wheelchair described in claim 1, wherein said multi-function, comfort wheelchair further comprises:

a detachable or secure article carrying means, said article carrying means located along the posterior surface of said back member; and a detachable or secure multi-sized cup holder, said multi-sized cup holder located on said wheelchair.

* * * * *